US008845349B2

(12) United States Patent
Shindo et al.

(10) Patent No.: US 8,845,349 B2
(45) Date of Patent: Sep. 30, 2014

(54) CONNECTOR

(71) Applicant: J.S.T. Mfg. Co., Ltd., Osaka (JP)

(72) Inventors: Satoru Shindo, Miyoshi (JP); Takamasa Yagi, Miyoshi (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 16 days.

(21) Appl. No.: 13/633,295

(22) Filed: Oct. 2, 2012

(65) Prior Publication Data

US 2013/0084751 A1 Apr. 4, 2013

(30) Foreign Application Priority Data

Oct. 3, 2011 (JP) ..... 2011-219497

(51) Int. Cl.
*H01R 13/629* (2006.01)
*H01R 13/631* (2006.01)
*H01R 13/533* (2006.01)
*H01R 13/115* (2006.01)

(52) U.S. Cl.
CPC ..... *H01R 13/6315* (2013.01); *H01R 13/115* (2013.01); *H01R 13/533* (2013.01); *H01R 2201/26* (2013.01)
USPC ..... 439/247

(58) Field of Classification Search
USPC ..... 439/246–248
See application file for complete search history.

(56) References Cited

U.S. PATENT DOCUMENTS

| | | | | |
|---|---|---|---|---|
| 4,738,631 | A * | 4/1988 | Takahashi et al. | 439/248 |
| 6,491,536 | B1 * | 12/2002 | Torii | 439/246 |
| 6,609,922 | B2 * | 8/2003 | Torii | 439/247 |
| 6,620,001 | B2 * | 9/2003 | Isshiki et al. | 439/844 |
| 6,773,283 | B2 * | 8/2004 | Yoshimatsu et al. | 439/180 |
| 6,939,154 | B2 * | 9/2005 | Horikoshi et al. | 439/247 |
| 2005/0079770 | A1 * | 4/2005 | Shindo | 439/686 |
| 2013/0084751 | A1 * | 4/2013 | Shindo et al. | 439/626 |

FOREIGN PATENT DOCUMENTS

| | | |
|---|---|---|
| JP | H5-17950 | 3/1993 |
| JP | 2006-260953 A1 | 9/2006 |

* cited by examiner

*Primary Examiner* — James Harvey
(74) *Attorney, Agent, or Firm* — Kratz, Quintos & Hanson, LLP

(57) ABSTRACT

A female contact 20 includes: a quadrangular tube 21; a curled portion 22 provided inside the quadrangular tube 21; and a curved portion 23, a projection 24 and a mounted portion 25 which are provided outside the quadrangular tube 21. The curved portion 23 is elastically displaced in a vertical direction. The quadrangular tube 21, the curved portion 23, and the mounted portion 25 are arranged so as to overlap one another when viewed from a direction orthogonal to a first wall 110 of the quadrangular tube 21. Further, the curved portion 23 and the mounted portion 25 are located within a width W of the first wall 110.

8 Claims, 12 Drawing Sheets

CONNECTOR

CROSS REFERENCE TO RELATED APPLICATION

This application claims priority from Japanese Patent Applications No. 2011-219497 which was filed on Oct. 3, 2011, the disclosure of which is herein incorporated by reference in its entirety.

BACKGROUND OF THE INVENTION

1. Field of the Invention

The present invention relates to a connector having a contact fixed to a housing.

2. Description of the Related Art

Since high-acceleration vibration is generated in the vicinity of an electric power supply or a power source (such as an engine) of an automobile, vibration resistance is required for a connector installed in an automobile. As a connector for automobiles, there has been known a connector including contacts each having: a mounted portion mounted on a base plate; a contact portion which comes into contact with a counterpart contact; and an elastic portion provided between the mounted portion and the contact portion. In this connector, the elastic portion is displaceable and thereby it absorbs vibration, so it is possible to prevent damage to the mounted portion and/or a crack in a solder joint, caused by the vibration. In such a connector, generally, the contact portion and the elastic portion of each contact are provided so that they are shifted relative to each other, that is, their locations are different from each other with respect to a direction in which the contacts are arranged (hereinafter referred to as an "arrangement direction of the contacts").

Meanwhile, Japanese Laid-Open Utility Model Publication No. 17950/1993 (Jitsukaihei 05-17950) discloses a contact including elastic portions (floating beams) which do not absorb vibration as described above but deal with positional deviation between the contact and a counterpart contact.

SUMMARY OF THE INVENTION

In the before-mentioned connector, the locations of the contact portion and the elastic portion of each contact are different from each other with respect to the arrangement direction of the contacts, and therefore, with respect to the arrangement direction, spaces are needed for the contact portion and the elastic portion, respectively. This causes a problem that the size of the connector is increased.

An object of the present invention is to provide a connector capable of absorbing vibration while achieving a downsizing.

A connector of the present invention includes: a housing; and a contact fixed to the housing, the housing including an accommodation chamber which accommodates apart of the contact, and a first opening which allows the accommodation chamber to communicate with an external space and a counterpart contact passes through, the contact including a quadrangular tube which is accommodated in the accommodation chamber and has two open ends opposed to each other, a first contact portion which is located inside the quadrangular tube and is brought into contact with the counterpart contact, a mounted portion which is located outside the quadrangular tube and is mounted on a base plate, and an elastic portion which is provided at a position such that the elastic portion couples the quadrangular tube to the mounted portion, and is elastically displaceable in a direction in which the two open ends of the quadrangular tube are opposed to each other, wherein: the quadrangular tube includes a first wall provided between the first contact portion and the mounted portion, and second and third walls which are contiguous with the first wall and opposed to each other in a direction parallel to a plane of the first wall; the quadrangular tube and the elastic portion are arranged so as to overlap one another when viewed from a direction orthogonal to the first wall; and the mounted portion and the elastic portion are located within a width of the first wall, the width being a length of the first wall with respect to a direction in which the second and third walls are opposed to each other.

Here, the expression that "the mounted portion and the elastic portion are located within a width of the first wall" includes the meaning that the respective lengths of these members in the above direction are equal to or smaller than the width of the first wall.

According to the present invention, since the mounted portion and the elastic portion of the contact are located within the width of the first wall, the width of the contact is decreased. As a result, the downsizing of the connector is achieved while vibration is absorbed by the elastic portion.

In the present invention, it is preferable that: the housing includes a second opening which allows the accommodation chamber to communicate with the external space and an insertion member passes through, the insertion member being inserted into the accommodation chamber at an opposite side of the accommodation chamber from that of the counterpart contact; the contact includes a second contact portion which is located inside the quadrangular tube and is brought into contact with the insertion member; and the second contact portion is displaced toward the first contact portion, and thereby the first contact portion is displaced in a same direction as that of the second contact portion.

In this structure, when the insertion member is inserted into the accommodation chamber of the housing and thereby the insertion member is brought into contact with the second contact portion of the contact, the second contact portion is displaced toward the first contact portion and the first contact portion is displaced toward the counterpart contact. Therefore, contact reliability between the first contact portion and the counterpart contact is improved. This prevents poor electrical connection between the connector and the counterpart connector.

Further, in the present invention, it is preferable that the contact includes a fixed portion which is provided between the elastic portion and the mounted portion and is fixed to the housing. In the above structure, vibration absorbed by the elastic portion is transmitted to the housing via the fixed portion, and therefore, it is less likely that the vibration is transmitted to the mounted portion. As a result, it is possible to prevent damage to the mounted portion, and/or damage to a solder joint between the mounted portion and the base plate (a crack in the solder joint is prevented).

In addition, in the present invention, it is preferable that: the elastic portion includes bent portions and connecting portions each connecting two of the bent portions to each other; the bent portions and the connecting portions are arranged in a plane parallel to the first wall; and two connecting portions provided at both ends of one of the bent portions are arranged so as to overlap each other when viewed from the direction in which the two open ends of the quadrangular tube are opposed to each other. In this structure, the elastic portion of the contact is bent in a plane parallel to the first wall of the quadrangular tube, and therefore the contact is downsized with respect to a direction orthogonal to a direction of the width of the first wall. With this, the connector is further downsized.

Further, in the present invention, it is preferable that the quadrangular tube further include a fourth wall which is contiguous with the second wall and the third wall and which faces the first wall; and the elastic portion is elastically displaceable in directions in which the two open ends of the quadrangular tube are opposed to each other, in directions in which the first and the fourth wall face each other, and in directions in which the second and third walls face each other. This enables absorption of vibration in various directions, because the elastic portion is elastically displaceable at least in three directions.

According to the present invention, there is provided a connector capable of absorbing vibration while achieving a downsizing.

DESCRIPTION OF THE PREFERRED EMBODIMENTS

First Embodiment

The following describes a first embodiment of the present invention.

Figure 1:
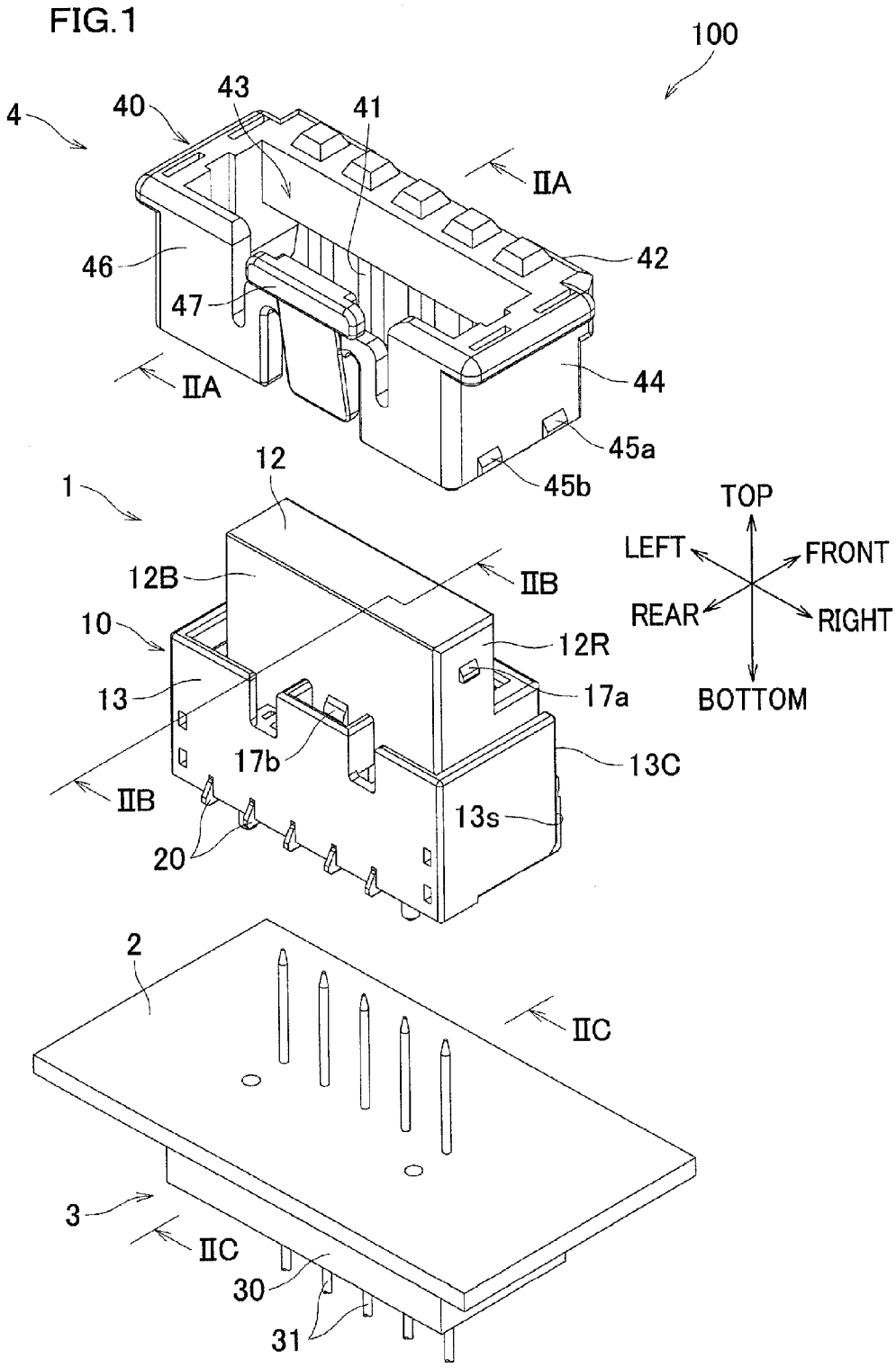
FIG. 1 is an exploded perspective view of a connector of a first embodiment of the present invention.
Figure 2A:
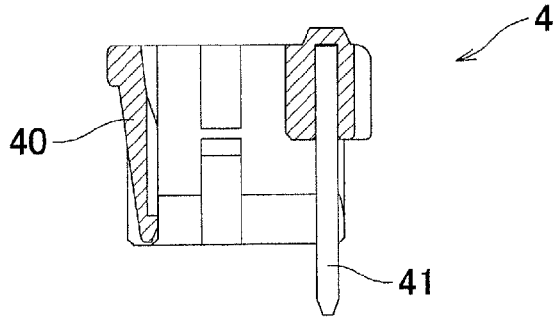
FIG. 2A is a sectional view taken along a line IIA-IIA of FIG. 1.
Figure 2B:
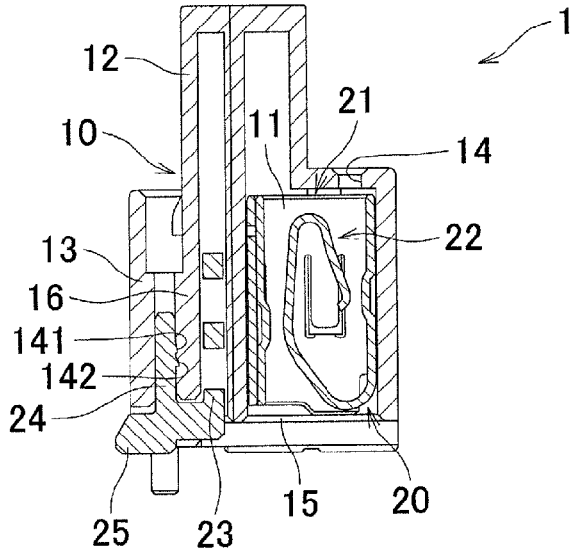
FIG. 2B is a sectional view taken along a line IIB-IIB of FIG. 1.
Figure 2C:
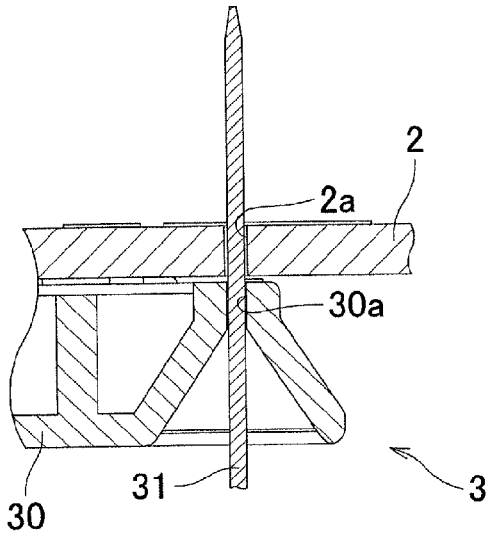
FIG. 2C is a sectional view taken along a line IIC-IIC of FIG. 1.

As shown in FIGS. 1 and 2A to 2C, a connector 100 includes: a female connector 1; a guide connector 3 disposed below a base plate 2; and a slide connector 4 to be fitted to an upper portion of the female connector 1. Note that, FIGS. 2A to 2C show these members so as to correspond to the illustration of FIG. 1, that is, FIG. 2A shows the slide connector 4, FIG. 2B shows the female connector 1, and FIG. 2C shows the base plate 2 and the guide connector 3.

<Female Connector 1>

As shown in FIG. 2B, the female connector 1 includes: a female housing (housing) 10 made of an insulating resin; and female contacts (contact) 20 attached to the female housing 10.

<Female Housing>

The female housing 10 includes: accommodation chambers 11 accommodating the respective female contacts 20; and a fitted portion 12 which is provided above the accommodation chambers 11 and is fitted to the slide connector 4; and a protection wall 13 provided outside the accommodation chambers 11 (see FIG. 1). In the female housing 10, the plurality of accommodation chambers 11 are formed in a line. Further, at an upper end portion of each accommodation chamber 11, there is formed an opening (second opening) 14 which allows the accommodation chamber 11 to communicate with an external space; whereas at a lower end portion of each accommodation chamber 11, there is formed an opening (first opening) 15 which allows the accommodation chamber 11 to communicate with the external space.

Furthermore, a fixation wall 16 is provided between the accommodation chambers 11 and the protection wall 13. Between each accommodation chamber 11 and the fixation wall 16, a curved portion 23 of the corresponding female contact 20 is inserted, and between the protection wall 13 and the fixation wall 16, a projection 24 of the female contact 20 is inserted.

As shown in FIG. 1, the fitted portion 12 is provided with: a protrusion 17*a* formed on its right side 12R; and a protrusion 17*b* formed on its back side 12B. The protrusions 17*a* and 17*b* are engaged with the slide connector 4. Further, a slit 13*s* extending in a vertical direction is formed at a corner 13C of the protection wall 13.

<Female Contact>

Figure 3A:
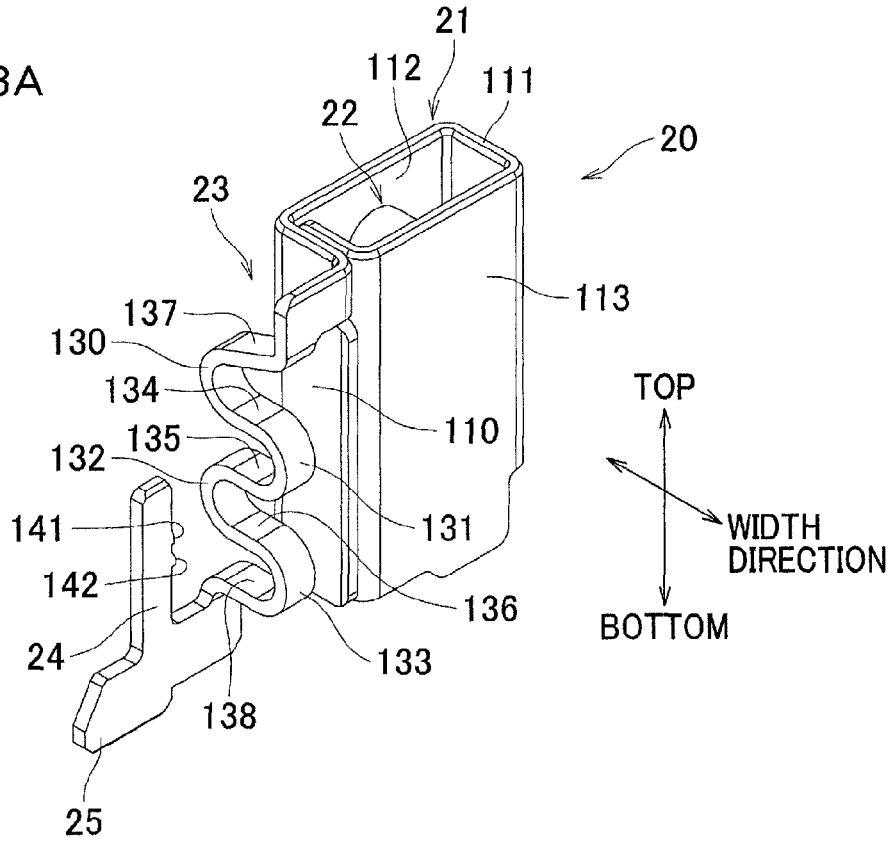
FIG. 3A is a perspective view of a female contact.
Figure 3B:
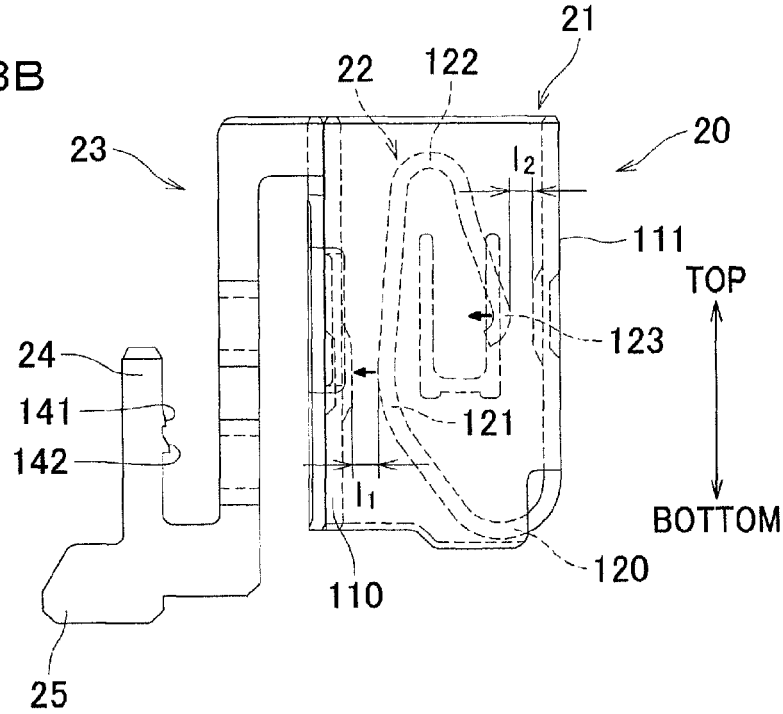
FIG. 3B is a front view of the female contact.

As shown in FIG. 3A, each female contact 20 includes: a quadrangular tube 21 having a substantially rectangular parallelepiped shape; a curled portion 22 provided inside the quadrangular tube 21; and the curved portion 23, the projection 24, and a mounted portion 25 which are provided outside the quadrangular tube 21. The mounted portion 25 is mounted on the base plate 2. As shown in FIG. 3B, the curved portion 23, the projection 24, and the mounted portion 25 are connected to one another in this order, from the side closer to the quadrangular tube 21. The female contact 20 is an electrically conductive member, and is formed of one metal plate.

<Quadrangular Tube>

As shown in FIG. 3A, the quadrangular tube 21 is a tube-like member having an open top and an open bottom which are opposed to each other. The quadrangular tube 21 includes: a first wall 110 provided between (i) the curled portion 22 located inside the quadrangular tube 21 and (ii) the curved portion 23 located outside the quadrangular tube 21; a second wall 111 located so as to be opposed to the first wall 110; and a third wall 112 and a fourth wall 113 which are contiguous with the first wall 110 and located so as to be opposed to each other in a direction parallel to the plane of the first wall 110 (a width direction shown in FIG. 3A). As shown in FIG. 2B, the quadrangular tube 21 is accommodated in the corresponding accommodation chamber 11 of the female housing 10.

Note that the first wall 110 in the present embodiment corresponds to the first wall in claims and the second wall 111 of the present embodiment corresponds to the fourth wall of the claims. Further, the third wall 112 and the fourth wall 113 of the present embodiment correspond to the second wall and the third wall of the claims, respectively.

<Curled Portion>

As shown in FIG. 3B, the curled portion 22 extends from a lower end the second wall 111 is bent so as to form a loop inside the quadrangular tube 21. The curled portion 22 includes: a spring portion 120 which extends from the lower end of the second wall 111 and is bent to form a downward projection; a curved portion (first contact portion) 121 which extends from the spring portion 120 and is curved to form a projection toward the first wall; a spring portion 122 which extends from the curved portion 121 and is bent to form an upward projection; and a projection (second contact portion) 123 which extends from the spring portion 122 to project toward the second wall.

When the projection 123 is displaced toward the curved portion 121 (see an arrow shown in FIG. 3B), the spring portions 120 and 122 are elastically deformed, and thereby the curved portion 121 is displaced in a same direction as that of the projection 123 (see another arrow shown in FIG. 3B), and the curved portion 121 approaches the first wall 110.

A contact 31 of the guide connector 3 is inserted between the first wall 110 and the curved portion 121 which are opposed to each other (see FIG. 5B), and in this embodiment, a distance $l_1$ between the first wall 110 and the curved portion 121 is designed to be substantially same as the thickness of the contact 31. Further, an insertion member 41 of the slide connector 4 is inserted between the second wall 111 and the projection 123 which are opposed to each other (see FIG. 5C), and in this embodiment, a distance $l_2$ between the second wall 111 and the projection 123 is somewhat smaller than the thickness of the insertion member 41.

<Curved Portion>

As shown in FIG. 3A, the curved portion 23 is contiguous with the first wall 110 of the quadrangular tube 21, and is provided at a position such that the curved portion 23 couples the quadrangular tube 21 to the mounted portion 25. As shown in FIG. 3A and FIG. 4B, the curved portion 23 is formed by bending it multiple times in a plane parallel to the first wall 110. The curved portion 23 includes: spring portions (bent portions) 130, 131, 132, and 133; a connecting portion 134 which connects the two successive spring portions 130 and 131 to each other; a connecting portion 135 which connects the two successive spring portions 131 and 132 to each other; and a connecting portion 136 which connects the two successive spring portions 132 and 133 to each other. As shown in FIG. 3A, the first wall 110 is connected to the spring portion 130 by a connecting portion 137, and the spring portion 133 is connected to the projection 24 by a connecting portion 138. As the spring portions 130, 131, 132 and 133 are elastically deformed, the curved portion 23 is elastically displaced in the vertical direction, and thereby vibration or the like is absorbed.

Figure 4A:
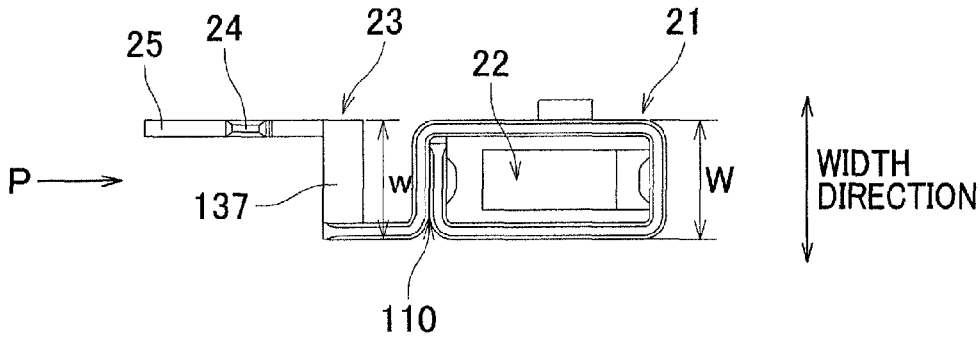
FIG. 4A is a plane view of the female contact.
Figure 4B:
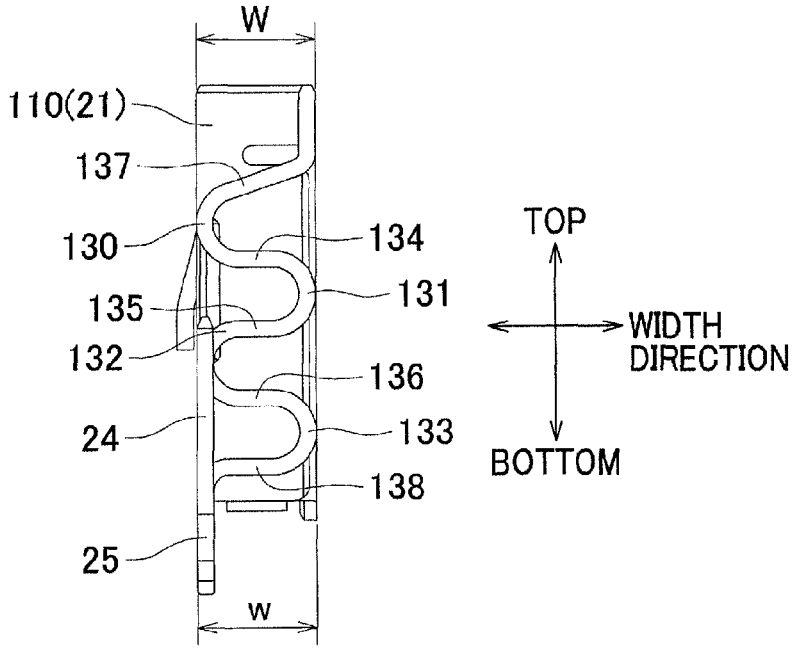
FIG. 4B is a side view of the female contact.

As shown in FIG. 3A, the spring portions 130, 131, 132 and 133, and the connecting portions 134, 135, 136, 137 and 138 are arranged in the plane parallel to the first wall 110 (see FIG. 3B and FIG. 4A). Further, as shown in FIG. 3A, the connecting portions 134, 135, 136, 137 and 138 each extends in the width direction of the first wall 110, and these portions are arranged so as to overlap one another when viewing the curved portion 23 from the vertical direction (see FIG. 4A). Here, the width direction of the first wall 110 is a direction in which the third wall 112 is opposed to the fourth wall 113.

<Projection>

As shown in FIGS. 3A and 3B, the projection 24 is a member projecting upwardly, and has protrusions 141 and 142 formed on its side portion. As shown in FIG. 2B, when the projection 24 is accommodated between the protection wall 13 and the fixation wall 16 of the female housing 10, the protrusions 141 and 142 are engaged with the fixation wall 16, and the projection 24 is fixed to the fixation wall 16.

As shown in FIGS. 4A and 4B, when viewing the female contact 20 from P direction orthogonal to the first wall 110, the quadrangular tube 21, the curved portion 23, the projection 24, and the mounted portion 25 are arranged so as to overlap one another. Further, with reference to the width direction, a width w of the curved portion 23 is same as a width W of the first wall (w=W). When viewed from the P direction orthogonal to the first wall 110, the curved portion 23, the projection 24, and the mounted portion 25 are located within the width W of the first wall. Here, FIG. 4B shows the female contact 20 viewed from the P direction orthogonal to the first wall 110.

<Guide Connector>

As shown in FIG. 2C, the guide connector 3 includes: a housing 30 made of an insulating resin; and a plurality of contacts 31 attached to the housing 30. Each contact 31 is a pin-shaped electrically conductive member, and is made of a metal material. Each contact 31 passes through a corresponding through hole 30*a* formed in the housing 30, and projects toward the female connector 1. The contact 31 is inserted through the corresponding opening 15 of the female housing 10 into the corresponding accommodation chamber 11 (see FIG. 5B).

The base plate 2 is disposed above the housing 30. In the base plate 2, through holes 2*a* are bored through which the respective contacts 31 pass.

<Slide Connector>

As shown in FIGS. 1 and 2A, the slide connector 4 includes: a housing 40 made of an insulating resin; and insertion members 41 attached to the housing 40.

As shown in FIG. 1, the housing 40 includes: a substantially tube-shaped wall 42; and a hole 43 formed inside the wall 42. Into the hole 43, the fitted portion 12 of the female connector 1 is fitted. Protrusions 45*a* and 45*b* are formed on a right side portion 44 of the wall 42. The protrusions 45*a* and 45*b* are engaged with the protection wall 13 of the female housing 10. In the same way, protrusions to be engaged with the protection wall 13 are formed also on a left side portion of the wall 42.

Figure 6A:
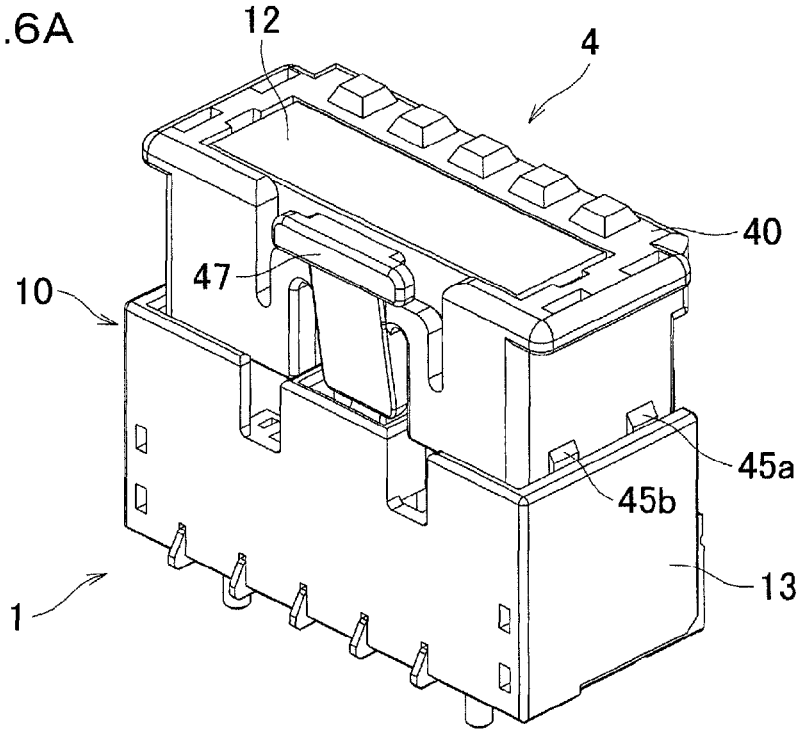
FIGS. 6A and 6B show the process of assembling the connector.
Figure 6B:
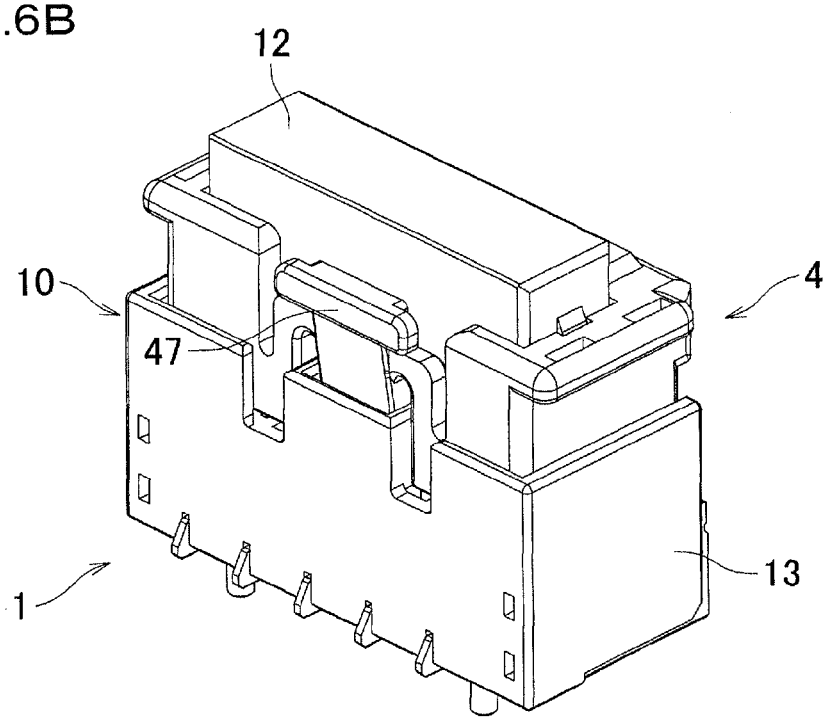

An unlocking portion 47 is provided near a substantially central portion of a back side portion 46 of the wall 42. When the female connector 1 is fitted to the slide connector 4 as shown in FIG. 6B, they are released from each other by pressing the unlocking portion 47.

As shown in FIG. 2A, each insertion member 41 is a pin-shaped electrically conductive member, and is made of a metal material. The insertion members 41 project toward the female connector 1. Further, each insertion member 41 is inserted through the corresponding opening 14 of the female housing 10 into the corresponding accommodation chamber 11 (see FIGS. 5A to 5C).

The following describes a process of assembling the connector 100 with reference to FIGS. 5A to 5C, and 6A and 6B. Note that, in FIGS. 6A and 6B, the base plate 2 and the guide connector 3 are not illustrated.

Figure 5A:
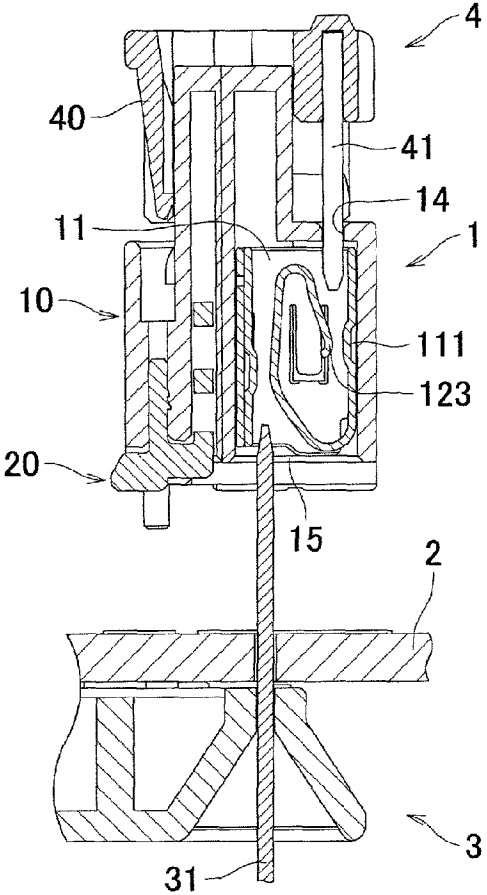
FIGS. 5A to 5C show a process of assembling the connector.

As shown in FIG. 5A, the slide connector 4 is provisionally fitted to the female connector 1. At this time, each insertion member 41 of the slide connector 4 is inserted into the corresponding accommodation chamber 11 through the corresponding opening 14 of the female connector 1; however, it has not been inserted between the second wall 111 and the projection 123. Further, as shown in FIG. 6A, the protrusions 45*a* and 45*b* of the housing 40 are in contact with an upper end of the protection wall 13 of the female housing 10.

Figure 5B:
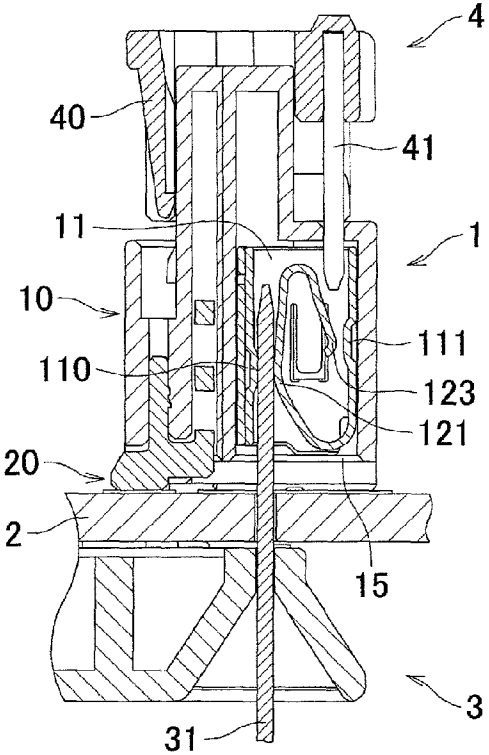

Then, each contact 31 of the guide connector 3, the contact 31 projecting from the base plate 2, is inserted through the corresponding opening 15 of the female connector 1 into the corresponding accommodation chamber 11. As shown in FIG. 5B, the contact 31 is inserted between the first wall 110 and the curved portion 121, and the female connector 1 and the slide connector 4 which are provisionally fitted to each other are placed on the base plate 2. The first wall 110 and the curved portion 121 are brought into contact with the contact 31, and thereby electrical connection between the female contact 20 and the contact 31 is achieved. Note that, the electrical connection between the female contact 20 and the contact 31 is achieved when either one of the first wall 110 and the curved portion 121 is brought into contact with the contact 31.

Figure 5C:
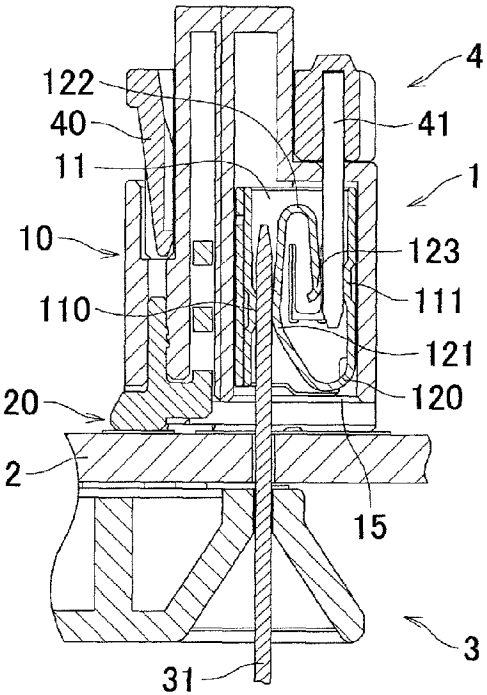

Thereafter, as shown in FIGS. 5C and 6B, the slide connector 4 is completely fitted to the female connector 1. When each insertion member 41 of the slide connector 4 is inserted between the second wall 111 and the projection 123, the projection 123 is displaced toward the curved portion 121, and the spring portions 120 and 122 are elastically deformed. With this, the curved portion 121 is displaced toward the contact 31 and the first wall 110.

As described above, the connector 100 of this embodiment brings about the following advantageous effects. Since the curved portion 23 and the mounted portion 25 of the female contact 20 are located within the width of the quadrangular tube 21 when viewing the female contact 20 from the P direction orthogonal to the first wall 110, the width of the female contact 20 is decreased. As a result, the downsizing of the female connector 1 and the connector 100 is achieved while vibration is absorbed by the curved portion 121.

Further, each insertion member 41 of the slide connector 4 is inserted between the second wall 111 and the projection 123 in the corresponding accommodation chamber 11, and thereby the projection 123 is displaced toward the curved portion 121 and the spring portions 120 and 122 are elastically deformed. As a result, the curved portion 121 is displaced toward the contact 31, and this improves the contact reliability between: the curved portion 121 and the first wall 110; and the contact 31. Accordingly, poor electrical connection between the female connector 1 and the guide connector 3 is prevented.

Further, in the female contact 20, the projection 24 provided between the curved portion 23 and the mounted portion 25 is fixed to the fixation wall 16 of the female housing 10, and therefore vibration absorbed by the curved portion 23 is transmitted to the female housing 10 via the projection 24. With this, it is less likely that the vibration is transmitted to the mounted portion 25, and this prevents damage to the mounted portion 25, or damage to a solder joint between the mounted portion 25 and the base plate 2 (a crack in the solder joint is prevented).

In addition to the above, since the curved portion 23 of the female contact 20 is bent in the plane parallel to the first wall 110 of the quadrangular tube 21, the female contact 20 is downsized with respect to the direction orthogonal to the width direction (i.e., the P direction orthogonal to the first wall 110). As a result, further downsizing of the female connector 1 and the connector 100 is achieved.

Further, in each accommodation chamber 11 of the female housing 10, the distance $l_1$ between the first wall 110 and the curved portion 121 which are opposed to each other is substantially same as the thickness of each contact 31 of the guide connector 3, and therefore, it is possible to insert the contact 31 between the first wall 110 and the curved portion 121 with a small force. Furthermore, since the distance $l_2$ between the second wall 111 and the projection 123 which are opposed to each other is smaller than the thickness of each insertion member 41 of the slide connector 4, when the insertion member 41 is inserted between the second wall 111 and the projection 123, the projection 123 is displaced toward the curved portion 121, with the result that the curved portion 121 is displaced toward the contact 31. With this, reliable contact between the female contact 20 and the contacts 31 is provided. Accordingly, while the contacts 31 are able to be inserted with a small force, the reliable contact between the female contact 20 and the contacts 31 is achieved.

Moreover, since the vertical slit 13*s* is formed at the corner 13C of the protection wall 13 of the female housing 10, when the female connector 1 is fitted to the slide connector 4, a reaction force acting from the protection wall 13 toward the slide connector 4 (the protrusions 45*a* and 45*b*) is improved. Further, since a sound of engagement is produced when the protrusions 45*a* and 45*b* are engaged with the protection wall 13, it is easily detected whether the female connector 1 has been adequately fitted to the slide connector 4.

Second Embodiment

Figure 7:
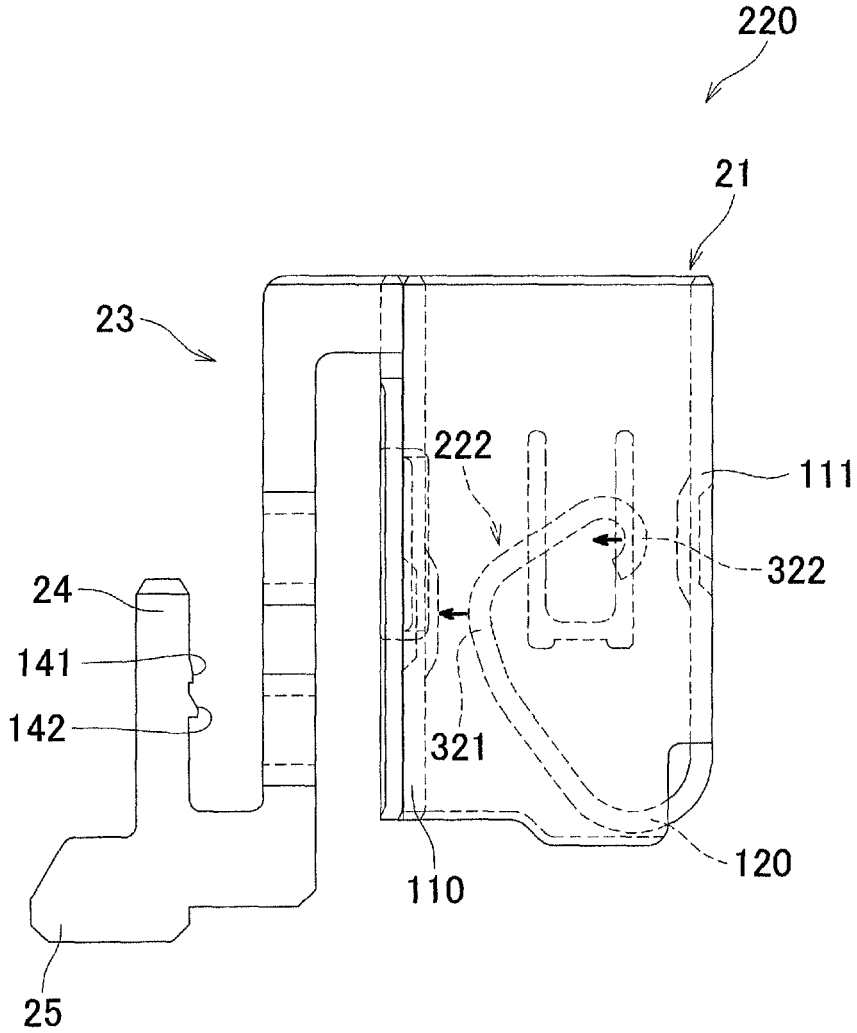
FIG. 7 is a front view of a female connector of a second embodiment of the present invention.

The following describes a second embodiment of the present invention, with reference to FIG. 7. A connector of the second embodiment is different from the connector of the first embodiment in the following point. Whereas in the first embodiment, the spring portion 122 is provided between the curved portion 121 and the projection 123 of the female contact 20; in the second embodiment, such a spring portion is not provided between a bent portion 321 and a projection 322 of a female contact 220. The other components are similar to those in the first embodiment, and therefore the same reference numerals are given to these components, and the description thereof will be omitted, if appropriate.

<Female Contact 220>

As shown in FIG. 7, the female contact 220 includes: the quadrangular tube 21; a curled portion 222 provided inside the quadrangular tube 21; and the curved portion 23, the projection 24, and mounted portion 25 which are provided outside the quadrangular tube 21.

The curled portion 222 includes: the spring portion 120, the bent portion (first contact portion) 321 which extends from the spring portion 120 and is bent to form a projection toward the first wall; and the projection (second contact portion) 322 which extends from the bent portion 321 to project toward the second wall. When the projection 322 is displaced toward the bent portion 321 (see an arrow shown in FIG. 7), the spring portion 120 is elastically deformed, and thereby the bent portion 321 is displaced in the same direction as that of the projection 322 (see another arrow shown in FIG. 7), and the bent portion 321 approaches the first wall 110.

As described above, in the connector of the second embodiment, vibration is absorbed by the curved portion 23, and the downsizing of the female connector and the connector is also achieved, as well as the connector 100 of the first embodiment.

Hereinabove, the first and second embodiments of the present invention have been described. However, the present invention should not be narrowly interpreted within the limits of such embodiments and alternative forms, but rather may be applied in many variations within the scope of the claims.

The structure of the female contact 20 is not limited to those of the first embodiment and the second embodiment. For example the structure of the female contact 20 is modifiable as described in first and second modifications described below.

[First Modification]

The following describes a modification of the present invention, with reference to FIGS. 8A and 8B and FIGS. 9A and 9B. The first modification is different from the first embodiment in the shape of the curved portion (elastic portion) and the position of the projection (fixed portion). Note that structures identical to those of the first embodiment are given the same reference numerals and explanation for such structures is omitted as needed.

Figure 8A:
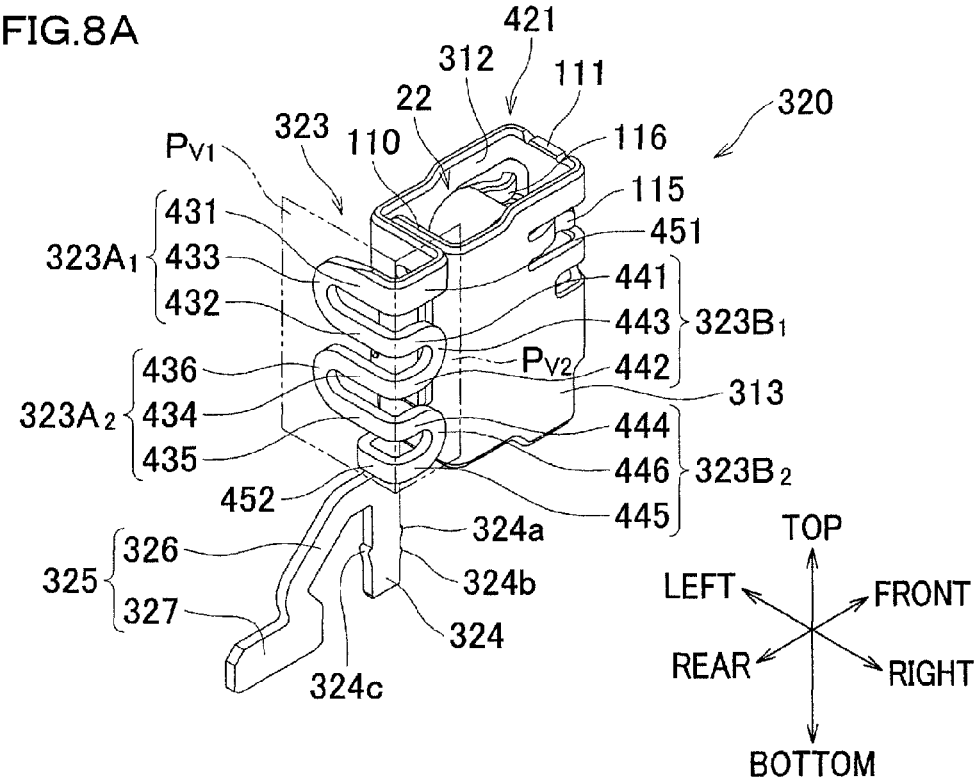
FIG. 8A is a perspective view of a female contact of a first modification.
Figure 8B:
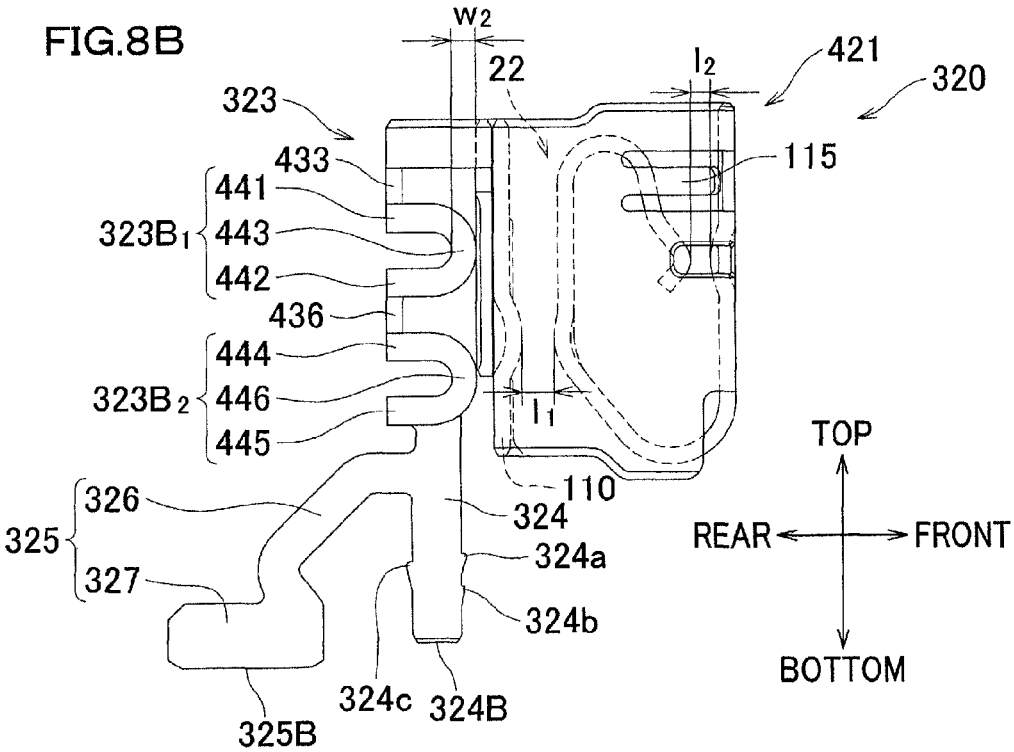
FIG. 8B is a front view of the female contact of the first modification.

As shown in FIGS. 8A and 8B, a curved portion 323 of a female contact 320 in the first modification includes: first portions 323$A_1$ and 323$A_2$ which are arranged within a first imaginary plane $P_{v1}$ parallel to a first wall 110, and second portions 323$B_1$ and 323$B_2$ arranged within a second imaginary plane $P_{v2}$ parallel to the fourth wall 313. Within this curved portion 323, the first portion 323$A_1$, the second portion 323$B_1$, the first portion 323$A_2$, and the second portion 323$B_2$ are arranged sequentially from the top, and are connected in this order. Further, an upper end of the curved portion 323 connects to the first wall 110 via a horizontal portion 451 extended in a horizontal direction within the second imaginary plane $P_{v2}$. A lower end of the curved portion 323 connects to a projection 324 via a horizontal portion 452 extended in a horizontal direction within the first imaginary plane $P_{v1}$.

The first portion 323$A_1$ is formed substantially in a U-shape protruding towards the left, and includes two straight portions (connecting portions) 431, and 432 each extended in a horizontal direction within the first imaginary plane $P_{v1}$; and a semi-circular portion (bent portion) 433 having substantially semi-circular shape. The two straight portions 431, 432 are sequentially arranged from the top in a vertical direction, and the left ends thereof are connected via the semi-circular portion 433, thus forming the first portion 323$A_1$ which is substantially U-shaped as a whole. The first portion 323$A_2$ has substantially the same structure as that of the first portion 323$A_1$, and includes two straight portions (connecting portions) 434 and 435 extended in a horizontal direction within the first imaginary plane $P_{v1}$, and a semi-circular portion (bent portion) 436 having substantially a semi-circular shape. The left ends of the straight portions 434 and 435 are connected to each other via the semi-circular portion 436, thus forming the first portion 323$A_2$ which is substantially U-shaped as a whole.

Figure 9A:
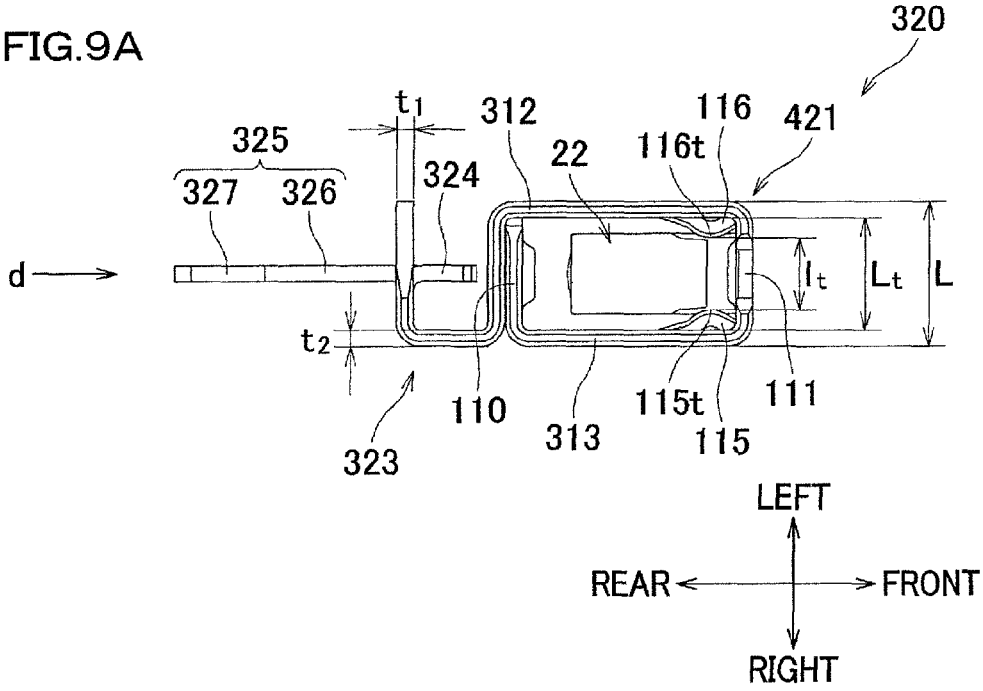
FIG. 9A is a front view of the female contact of the first modification.
Figure 9B:
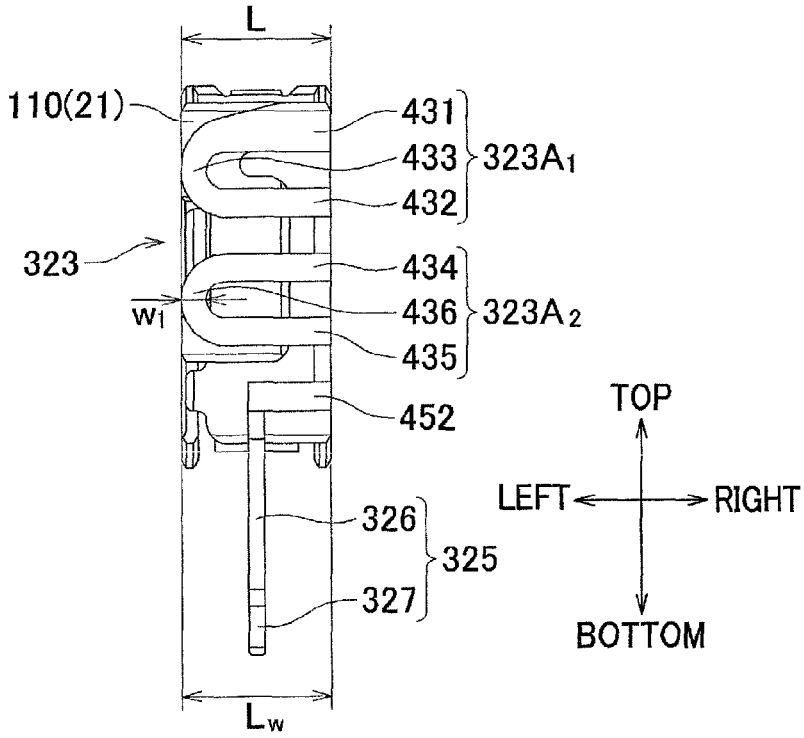
FIG. 9B is a side view of the female contact of the first modification.

As shown in FIGS. 9A and 9B, in the first imaginary plane Pv1, the width $w_1$ (width $w_1$ in FIG. 9B) of the first portions 323$A_1$ and 323$A_2$ is greater than the thickness $t_1$ (thickness $t_1$ in FIG. 9A) ($w_1>t_1$). Here, the width $w_1$ of the first portions 323$A_1$ and 323$A_2$ is a size in a direction perpendicular to a direction in which the first portion 323$A_1$ and 323$A_2$ are extended. The thickness $t_1$ is a size in a direction perpendicular to the first imaginary plane $P_{v1}$ (direction perpendicular to the first wall 110).

With the structure, the first portions 323$A_1$ and 323$A_2$ are elastically displaceable in the vertical directions and in the front/rear directions (see FIG. 8A).

Further, as shown in FIGS. 8A and 8B, the second portion 323$B_1$ is formed substantially in a U-shape protruding towards the front, and includes two straight portions (connecting portions) 441 and 442 each extended in a horizontal direction within the second imaginary plane $P_{v2}$; and a semi-circular portion (bent portion) 443 having substantially semi-circular shape. The two straight portions 441 and 442 are sequentially arranged in a vertical direction, and the front ends thereof are connected via the semi-circular portion 443, thus forming the first portion 323$B_1$ which is substantially U-shaped as a whole. The second portion 323$B_2$ has substantially the same structure as that of the first portion 323$B_1$, and includes two straight portions (connecting portions) 444 and 445 extended in a horizontal direction within the second imaginary plane $P_{v2}$, and a semi-circular portion (bent portion) 446 having substantially a semi-circular shape. The front ends of the straight portions 444 and 445 are connected to each other via the semi-circular portion 446, thus forming the first portion 323$B_2$ which is substantially U-shaped as a whole.

As shown in FIGS. 8B and 9A, in the second imaginary plane $P_{v2}$, the width $w_2$ (width $w_2$ in FIG. 8B) of the second portions 323$B_1$ and 323$B_2$ is greater than the thickness $t_2$ (thickness $t_2$ in FIG. 9A) ($w_2>t_2$). Here, the width $w_2$ of the second portions 323$B_1$ and 323$B_2$ is a size in a direction perpendicular to a direction in which the second portions 323$B_1$ and 323$B_2$ are extended. The thickness $t_2$ is a size in a direction perpendicular to the second imaginary plane $P_{v2}$.

With the structure, the second portions 323$B_1$ and 323$B_2$ are elastically displaceable in the vertical directions and in the left/right directions, as shown in FIG. 8A.

When the female contact 320 is viewed from a direction d which is perpendicular to the first wall 110, the quadrangular tube 421, the curved portion 323, the projection 324, and the mounted portion 325 are arranged so as to overlap one another, as shown in FIG. 9A and FIG. 9B. Further, the width $L_w$ of the curved portion 323 relative to the width direction is the same as the width L of the first wall ($L_w$=L). The curved portion 323, the projection 324, and the mounted portion 325 are within a range which is the same as the width of the first wall, when viewed from a direction P perpendicular to the first wall 110. Thus, the present modification also brings about the effects of the present invention.

Further, as shown in FIG. 8A, the first portions 323$A_1$ and 323$A_2$ of the curved portion 323 are elastically displaceable in the vertical directions and in the front/rear directions. The second portions 323$B_1$ and 323$B_2$ are elastically displaceable in the vertical directions and the left/right directions. Therefore, the curved portion 323 as a whole is elastically displaceable in the vertical directions, the front/rear directions, and the left/right directions. This enables absorption of vibration in various directions.

In the first modification, the projection (fixed portion) 324 is disposed below the curved portion 323, and the mounted portion 325 extends obliquely downwards from a midway portion of the projection 324. On side surfaces of the projection 324 are projections 324*a*, 324*b*, and 324*c* which engage with the female housing. The mounted portion 325 is structured by an extended portion 326 extending obliquely downwards from the midway portion of the projection 324 towards the rear side, and a horizontal portion 327 extended in a horizontal direction, which is connected to the extended portion 326 at its rear end. The horizontal portion 327 is soldered to the base plate 2. As shown in FIG. 8B, the bottom 327B of the horizontal portion 327 is lower than the bottom 324B of the projection 324.

By arranging the projection 324 below the curved portion 323, the vibration absorbed by the curved portion 323 is directly transmitted to the projection 324, and to the housing thereafter. Therefore, the vibration is prevented from being transmitted to the mounted portion 325. This prevents damages to the mounted portion 325 and the damages to the solder joint (crack in a solder joint).

Further, in the first modification, as shown in FIGS. 8A and 9A, the third wall 312 and the fourth wall 313 respectively have bent portions 115 and 116 which are bent so as to form convex towards the inside of the quadrangular tube 421. As shown in FIG. 9A, the bent portion 115 and the bent portion 116 are convexed to get close to each other, and a distance $l_t$ between the vertext 115*t* of the bent portion 115 and the vertext 116*t* of the bent portion 116 is shorter than a distance $L_t$ between the third wall 312 and the fourth wall 313 ($l_t<L_t$).

Here, when the charged female contact 320 touches the contact 31 (see FIG. 2C), the static charge at the female contact 320 may flow into a circuit mounted on the base plate via the contact 31. However, at a half-engaged position where the female contact 320 does not touch the contact 31, the insertion member 41 shown in FIG. 2A contacts the vertices 115*t* and 116*t* of the female contact 320. This releases the static charge at the female contact 320 to the insertion member 41 and to the housing 40. Therefore, even when the female contact 320 touches the contact 31 afterwards, the static charge is restrained from flowing into the circuit.

Next, another modification (second modification) of the female connector is described with reference to FIGS. 10A, 10B, 11A, 11B, 12A, and 12B.

[Second Modification]

The second modification is different from the first embodiment in the shape of the curved portion (elastic portion) and the position of the projection (fixed portion). Further, the second modification is different from the first modification in that the first portions $323A_1$ and $323A_2$ of the curved portion 323 are folded at substantially 90 degrees. In the second modification, the "semi-circular portions 433 and 436" of the first modification are referred to as "folded portions 633 and 636", respectively. Note that structures identical to those of the first embodiment are given the same reference numerals and explanation for such structures is omitted as needed.

Figure 10A:
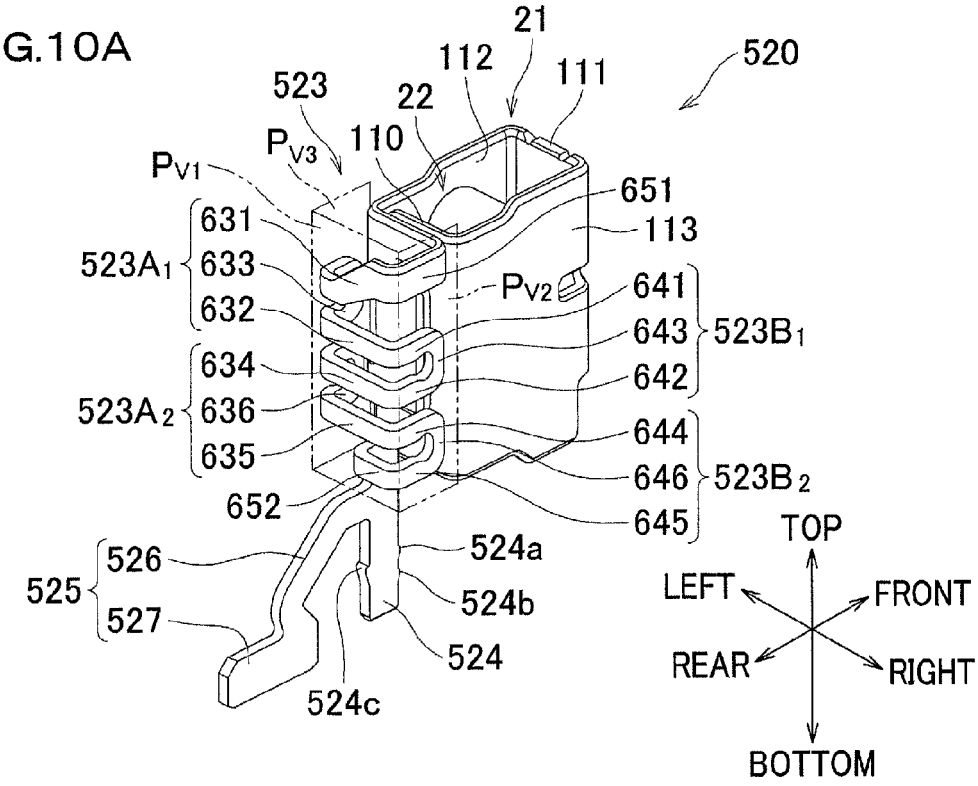
FIG. 10A is a perspective view of a female contact of a second modification, viewed from the front side.
Figure 10B:
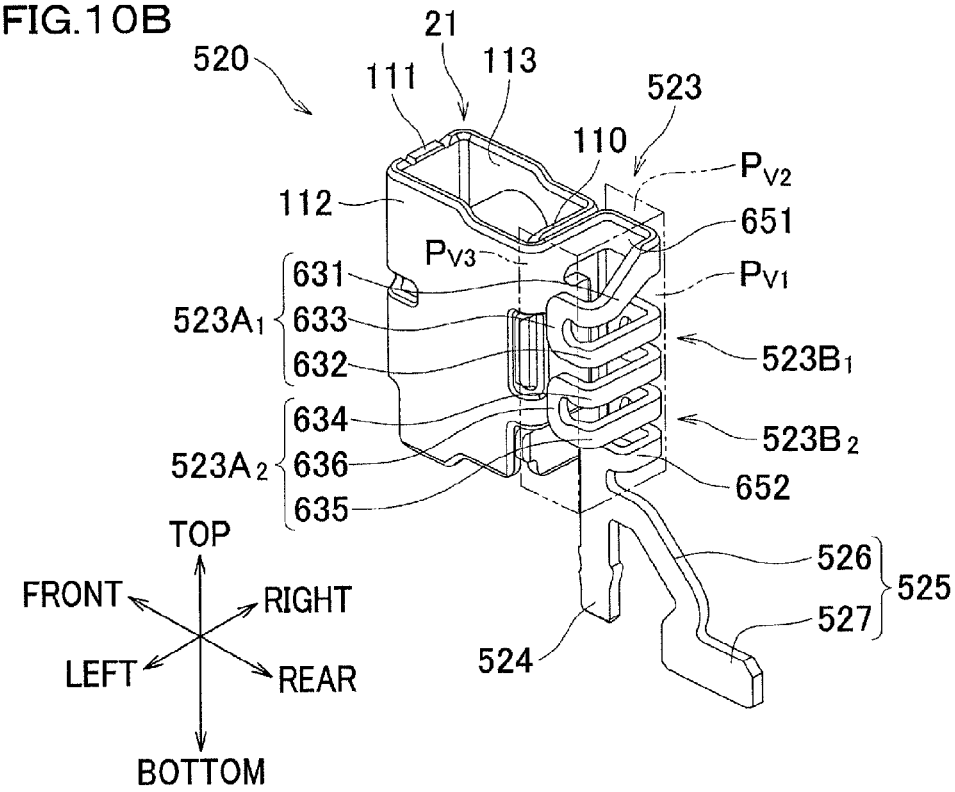
FIG. 10B is a perspective view of the female contact of the second modification, viewed from the rear side.

As shown in FIGS. 10A and 10B, a curved portion 523 of a female contact 520 includes: first portions $523A_1$ and $523A_2$ which are arranged within a first imaginary plane $P_{v1}$ parallel to a first wall 110 and within a third imaginary plane $P_{v3}$ parallel to a third wall 112, and second portions $523B_1$ and $523B_2$ arranged within a second imaginary plane $P_{v2}$ parallel to the fourth wall 113. Within this curved portion 523, the first portion $523A_1$, the second portion $523B_1$, the first portion $523A_2$, and the second portion $523B_2$ are arranged sequentially from the top, and are connected in this order. Further, an upper end of the curved portion 523 connects to the first wall 110 via a horizontal portion 651 extended in a horizontal direction within the second imaginary plane $P_{v2}$. A lower end of the curved portion 523 connects to a projection 524 via a horizontal portion 652 extended in a horizontal direction within the first imaginary plane $P_{v1}$.

As shown in FIG. 10B, the first portion $523A_1$ has straight portions (connecting portion) 631 and 632 extended substantially in a horizontal direction within a first imaginary plane $P_{v1}$, and a folded portion (bent portion) 633 disposed within the third imaginary plane $P_{v3}$. The folded portion 633 is bent to be folded so as to project towards the front (see FIG. 11B). The two straight portions 631, 632 are sequentially arranged from the top in a vertical direction, and the left ends thereof are connected via the folded portion 633, thus forming the first portion $623A_1$ which is substantially U-shaped as a whole. The first portion $623A_2$ has substantially the same structure as that of the first portion $623A_1$, and includes two straight portions (connecting portions) 634 and 635 extended in a horizontal direction within the first imaginary plane Pv1, and a folded portion (bent portion) 636 having substantially disposed within the third imaginary plane $P_{v3}$. The left ends of the straight portions 634 and 635 are connected to each other via the folded portion 636, thus forming the first portion $623A_2$ which is substantially U-shaped as a whole (see FIGS. 10B and 11B).

Figure 11A:
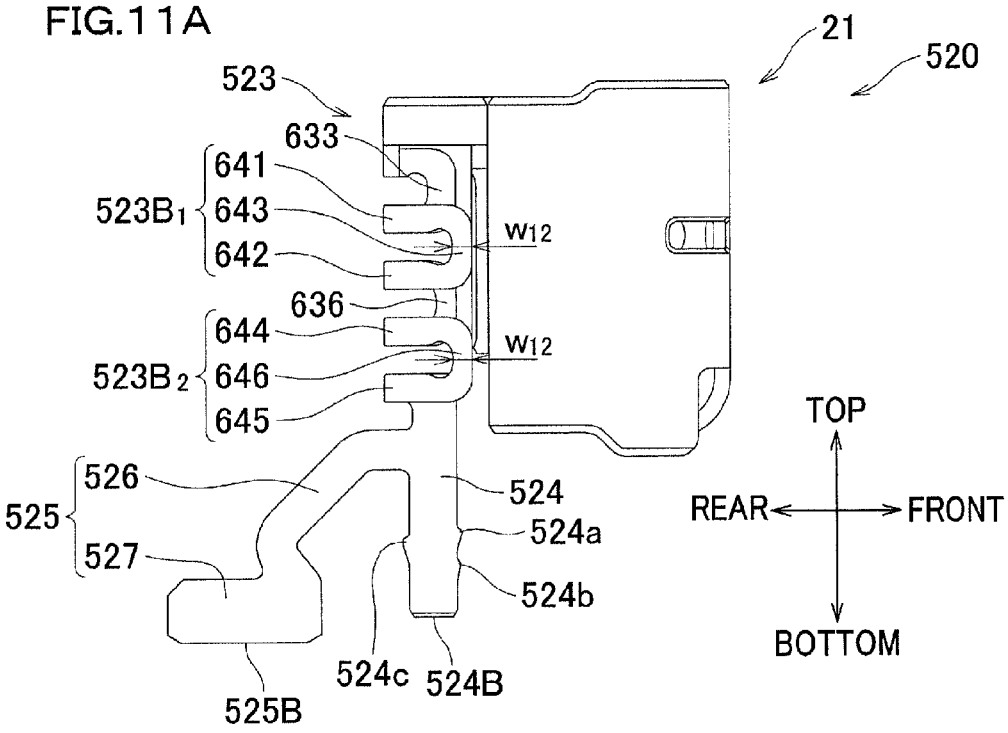
FIG. 11A is a front view of the female contact of the second modification.
Figure 11B:
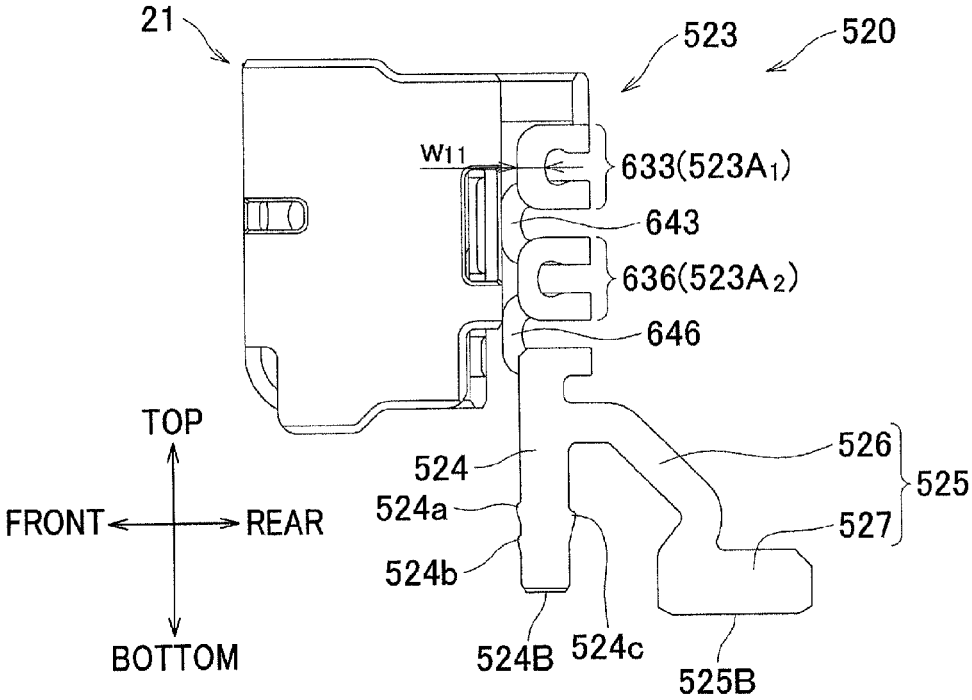
FIG. 11B is a rear view of the female contact of the second modification.
Figure 12A:
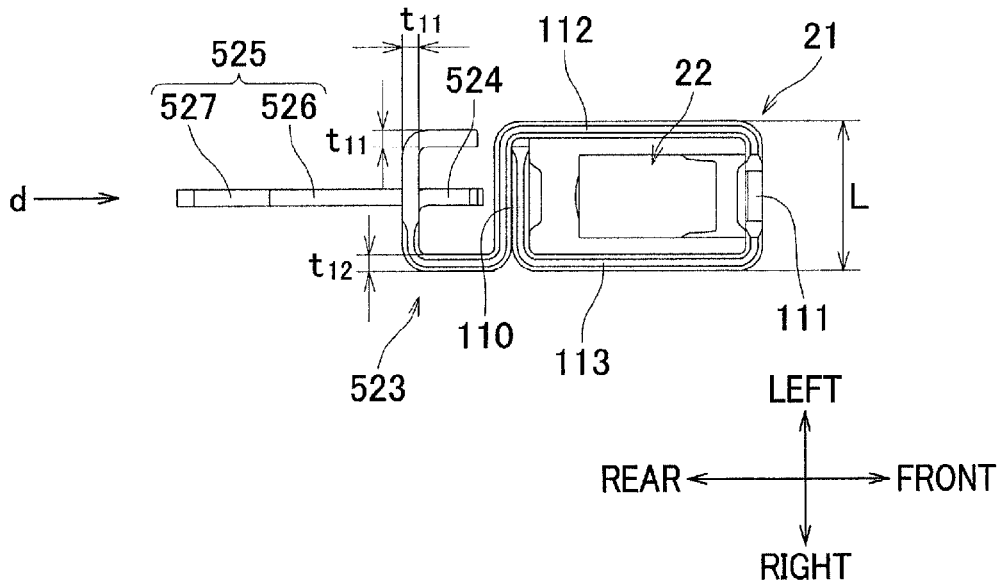
FIG. 12A is a front view and a side view of the female contact of the second modification.

As shown in FIGS. 11B and 12A, in the first imaginary plane $P_{v1}$ and the third imaginary plane $P_{v3}$, the width w11 (width $w_{11}$ in FIG. 11B) of the first portions $523A_1$ and $523A_2$ is greater than the thickness $t_{11}$ (thickness $t_{11}$ in FIG. 12A) ($w_{11}>t_{11}$). Here, the width $w_{11}$ of the first portions $523A_1$ and $523A_2$ is a size in a direction perpendicular to a direction in which the first portion $523A_1$ and $523A_2$ are extended. The thickness $t_{11}$ is the thickness of the metal plate forming the female contact 520. The thickness $t_{11}$ indicates a size of the straight portions 631 and 632 arranged on the first imaginary plane $P_{v1}$, relative to a direction perpendicular to the first imaginary plane $P_{v1}$ (first wall 110), and also indicates a size of the folded portion 633 arranged within the third imaginary plane $P_{v3}$ relative to a direction perpendicular to the third imaginary plane $P_{v3}$ (direction perpendicular to the third wall 112).

With the structure, the first portions $523A_1$ and $523A_2$ are elastically displaceable in the vertical directions and in the front/rear directions (see FIG. 10B).

Further, as shown in FIGS. 10A and 11B, the second portion $523B_1$ is formed substantially in a U-shape protruding towards the front, and includes two straight portions (connecting portions) 641 and 642 each extended in a horizontal direction within the second imaginary plane $P_{v2}$; and a folded portion (bent portion) 643. The folded portion 643 is bent to be folded so as to project towards the front. The two straight portions 641, 642 are sequentially arranged from the top in a vertical direction, and the front ends thereof are connected via the folded portion 643, thus forming substantially a U-shape as a whole. The second portion $523B_2$ has substantially the same structure as that of the first portion $523B_1$, and includes two straight portions (connecting portions) 644 and 645 extended in a horizontal direction within the second imaginary plane $P_{v2}$, and a folded portion (bent portion) 646. The front ends of the straight portions 644 and 645 are connected to each other via the folded portion 646, thus forming the first portion $523B_2$ which is substantially U-shaped as a whole.

As shown in FIGS. 11A and 12A, in the second imaginary plane $P_{v2}$, the width $w_{12}$ (width $w_{12}$ in FIG. 11A) of the first portions $523B_1$ and $523B_2$ is greater than the thickness $t_{12}$ (thickness $t_{12}$ in FIG. 12A) ($w_{12}>t_{12}$). Here, the width $w_{12}$ of the second portions $523A_1$ and $523A_2$ is a size in a direction perpendicular to a direction in which the second portion $523A_1$ and $523A_2$ are extended. The thickness $t_{12}$ is a size in a direction perpendicular to the second imaginary plane $P_{v2}$ (direction perpendicular to the fourth wall 113).

With the structure, the second portions $523B_1$ and $523B_2$ are elastically displaceable in the vertical directions and in the left/right directions, as shown in FIG. 10A.

Figure 12B:
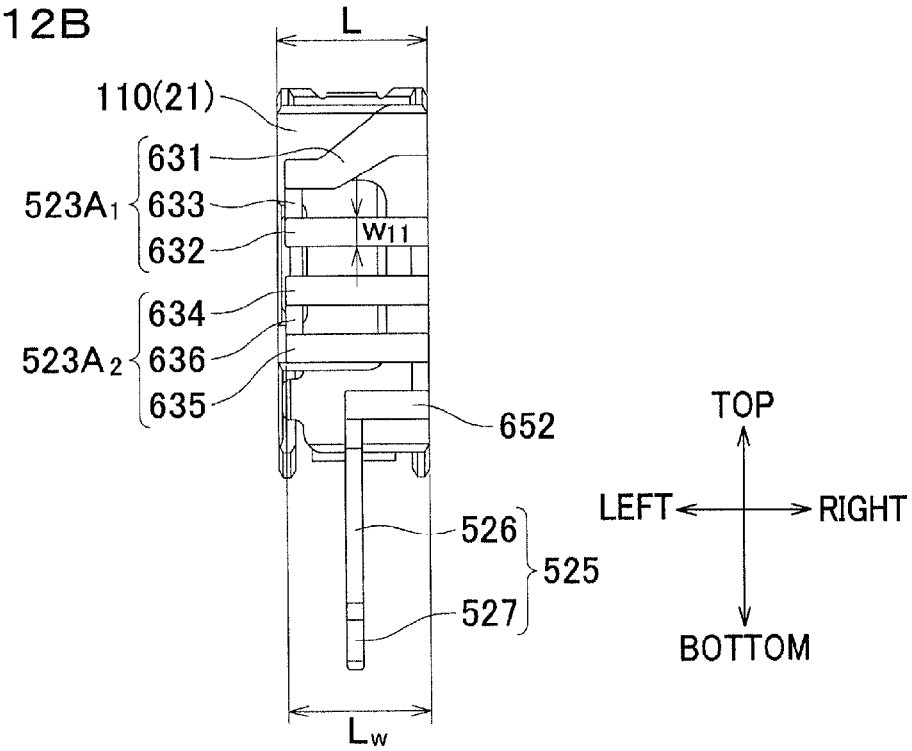
FIG. 12B is a side view of the female contact of the second modification.

When the female contact 520 is viewed from a direction d which is perpendicular to the first wall 110, the quadrangular tube 21, the curved portion 523, the projection 524, and the mounted portion 525 are arranged so as to overlap one another, as shown in FIG. 12A and FIG. 12B. Further, the width $L_w$ of the curved portion 523 relative to the width direction is smaller than the width L of the first wall ($L_w<L$). The curved portion 523, the projection 524, and the mounted portion 525 are within a range of the first wall, when viewed from a direction P perpendicular to the first wall 110. Thus, the present modification also brings about the effects of the present invention.

Further, as shown in FIGS. 10A and 10B, the first portions $523A_1$ and $523A_2$ of the curved portion 523 are elastically displaceable in the vertical directions and the front/rear directions. The second portions $523B_1$ and $523B_2$ are elastically displaceable in the vertical directions and the left/right directions. Therefore, the curved portion 523 as a whole is elastically displaceable in the vertical directions, the front/rear directions, and the left/right directions. This enables absorption of vibration in various directions.

Further, the present example has, within the third imaginary plane $P_{v3}$, the folded portions 633 and 636 which are formed by bending the first portions 523$A_1$ and 523$A_2$ at substantially 90 degrees. This improves the strength of the folded portions 633 and 636. Further, since the force of vibration is dispersed and not concentrated, the folded portions 633 and 636 are hardly damaged when the first portions 523$A_1$ and 523$A_2$ are elastically displaced in the vertical directions. Thus, the structure of the curved portion 523 is made hardly damageable.

As in the first modification, the projection 524 is disposed below the curved portion 523, and the mounted portion 525 extends obliquely downwards from a midway portion of the projection 524. On side surfaces of the projection 524 are projections 524*a*, 524*b*, and 524*c* which engage with the female housing. The mounted portion 525 is structured by an extended portion 526 extending obliquely downwards from the midway portion of the projection 524 towards the rear side, and a horizontal portion 527 extended in a horizontal direction, which is connected to the extended portion 526 at its rear end. The horizontal portion 527 is soldered to the base plate 2. The bottom 527B of the horizontal portion 527 is lower than the bottom 524B of the projection 524 (see FIGS. 11A and 11B).

By arranging the projection 524 below the curved portion 523, the vibration absorbed by the curved portion 523 is directly transmitted to the projection 524, and to the housing thereafter. Therefore, the vibration is prevented from being transmitted to the mounted portion 525. This prevents damages to the mounted portion 525 and the damages to the solder joint (crack in a solder joint).

Note that the second modification does not have the bent portions 115 and 116 in the quadrangular tube 21 which are indicated in the first modification (see FIG. 8A), the quadrangular tube 21 may be provided with the bent portions 115 and 116.

As described above, the curved portion (elastic portion) may be modified in various shapes.

For example, the first and the second embodiments each deals with the connector 100 including the slide connector 4; however, the connector 100 does not necessarily have to include the slide connector 4. In this case, the female contact 20, 220 does not have to have the projection 123, 322 which is brought into contact with the corresponding insertion member 41 of the slide connector 4. Further, when the distance $l_1$ between the first wall 110 and the curved portion 121 is designed to be smaller than the thickness of the contact 31, the contact reliability between the female connector and the each contact 31 is enhanced without using the slide connector 4.

Further, the first and the second embodiments each deals with the case where each contact (insertion member) 41 inserted between the second wall 111 and the projection 123, 322 being opposed to each other in the corresponding accommodation chamber 11 is made of a metal material. However, the material of each insertion member is not limited to metal, but may be a resin or the like. Furthermore, the housing 40 and the insertion members of the slide connector 4 may be formed into one piece.

Further, the first and the second embodiments each deals with the case where the projection (fixed portion) 24 is provided between the curved portion 23 and the mounted portion 25 of each female contact 20, 220; however, the fixed portion between the curved portion and the mounted portion may be omitted.

In addition to the above, the first and the second embodiments each deals with the case where the curved portion (elastic portion) 23 of each female contact 20, 220 is bent in the plane parallel to the first wall 110 of the quadrangular tube 21; however, the elastic portion of the female contact does not have to be bent in the plane parallel to the first wall. For example, the elastic portion of the female contact may be bent in a plane orthogonal to the first wall. Alternatively, the elastic portion of the female contact may be bent in a plane inclined relative to the first wall.

Further, the first and the second embodiments each deals with the case where the spring portions (bent portions) 130, 131, 132 and 133 of the curved portion (elastic portion) 23 and the connecting portions 134, 135, 136, 137 and 138 are arranged in the plane parallel to the first wall 110; however, such an arrangement of the bent portions and the connecting portions do not necessarily have to be made. In addition, not all of the bent portions and connecting portions have to be arranged in the plane parallel to the first wall 110. That is, only a part of the bent portions and/or only a part of the connecting portions may be arranged in the plane parallel to the first wall 110, or only the bent portions or only the connecting portions may be arranged in the plane parallel to the first wall 110. For example, the bent portions and the connecting portions may be arranged in a plane orthogonal to the first wall, or may be arranged in a plane inclined relative to the first wall.

Moreover, the first and the second embodiments each deals with the case where the connecting portions 134, 135, 136, 137 and 138 of the curved portion (elastic portion) 23 overlap one another when viewing the curved portion 23 from the vertical direction; however, not all of them have to overlap one another.

In addition to the above, the first and the second embodiments each deals with the case where, as shown in FIG. 4A, the width w of the curved portion 23 of the female contact 20 is the same as the width W of the first wall 110 (w=W); however, the width w of the curved portion may be smaller than the width W of the first wall (w<W). In this case, it is preferable that the curved portion 23 and the mounted portion 25 is located within the width W of the first wall 110 when viewing the female contact 20 from the P direction orthogonal to the first wall 110.

Further, the first and the second embodiments each deals with the case where, as shown in FIG. 4A, the projection (fixed portion) 24 is located within the width W of the first wall 110 when viewing the female contact 20 from the P direction orthogonal to the first wall 110; however, the projection 24 does not have to be located within the width W of the first wall.

Furthermore, the first and the second embodiments each deals with the case where the curved portion 23 of the female contact 20, 220 is bent multiple times; however, it is possible to arbitrarily change the number of times the curved portion 23 is bent, the shape of the curved portion 23, or the like. The number of times the curved portion 23 is bent may be only once.

In addition to the above, the first embodiment deals with the case where, as shown in FIG. 3B, the distance $l_1$ between the first wall 110 and the curved portion 121 is substantially same as the thickness of each contact 31; however, the distance may be larger than the thickness of each contact 31. In this case, each contact 31 is inserted with a further smaller force. Alternatively, as described above, the distance $l_1$ may be smaller than the thickness of each contact 31.

Moreover, the shape of the curled portion 22, 222 and the number of the spring portions of each female contact 20, 220 of the first or second embodiment is not limited to the shape and the number shown in FIG. 3B or 7, and may be arbitrarily changed.

In addition to the above, the first and the second embodiments each deals with the case where the female housing 10 is provided with the slit 13*s* and the protrusions 17*a* and 17*b*, and the housing 40 of the slide connector 4 is provided with the protrusions 45*a* and 45*b*; however, the positions, shapes, number or the like of the protrusions and the slit may be arbitrarily changed. Alternatively, the female connector does not have to be provided with the protrusions and the slit, and the slide connector does not have to be provided with the protrusions.

The above mentioned changes are also applicable to the first and second modifications.

What is claimed is:

1. A connector comprising: a housing; and a contact fixed to the housing, wherein:

the housing includes an accommodation chamber which accommodates a part of the contact, and a first opening which allows the accommodation chamber to communicate with an external space and a counterpart contact passes through;

the contact includes a quadrangular tube which is accommodated in the accommodation chamber and has two open ends opposed to each other, a first contact portion which is located inside the quadrangular tube and is brought into contact with the counterpart contact, a mounted portion which is located outside the quadrangular tube and is mounted on a base plate, and an elastic portion which is provided at a position such that the elastic portion couples the quadrangular tube to the mounted portion, and is elastically displaceable in a direction in which the two open ends of the quadrangular tube are opposed to each other;

the quadrangular tube includes a first wall provided between the first contact portion and the mounted portion, and second and third walls which are contiguous with the first wall and are opposed to each other in a direction parallel to a plane of the first wall;

the quadrangular tube and the elastic portion are arranged so as to overlap one another when viewed from a direction orthogonal to the first wall; and the mounted portion and the elastic portion are located within a width of the first wall, the width being a length of the first wall with respect to a direction in which the second and third walls are opposed to each other.

2. The connector according to claim 1, wherein:

the housing includes a second opening which allows the accommodation chamber to communicate with the external space and an insertion member passes through, the insertion member being inserted into the accommodation chamber at an opposite side of the accommodation chamber from that of the counterpart contact;

the contact includes a second contact portion which is located inside the quadrangular tube and is brought into contact with the insertion member; and the second contact portion is displaced toward the first contact portion, and thereby the first contact portion is displaced in a same direction as that of the second contact portion.

3. The connector according to claim 1, wherein the contact includes a fixed portion which is provided between the elastic portion and the mounted portion and is fixed to the housing.

4. The connector according to claim 1, wherein:

the elastic portion includes bent portions and connecting portions each connecting two of the bent portions to each other;

the bent portions and the connecting portions are arranged in a plane parallel to the first wall; and two connecting portions provided at both ends of one of the bent portions are arranged so as to overlap each other when viewed from the direction in which the two open ends of the quadrangular tube are opposed to each other.

5. The connector according to claim 1, wherein: the quadrangular tube further includes a fourth wall which is contiguous with the second wall and the third wall and which faces the first wall; and the elastic portion is elastically displaceable in directions in which the two open ends of the quadrangular tube are opposed to each other, in directions in which the first and the fourth wall face each other, and in directions in which the second and third walls face each other.

6. The connector according to claim 2, wherein the contact includes a fixed portion which is provided between the elastic portion and the mounted portion and is fixed to the housing.

7. The connector according to claim 2, wherein:

the elastic portion includes bent portions and connecting portions each connecting two of the bent portions to each other;

the bent portions and the connecting portions are arranged in a plane parallel to the first wall; and two connecting portions provided at both ends of one of the bent portions are arranged so as to overlap each other when viewed from the direction in which the two open ends of the quadrangular tube are opposed to each other.

8. The connector according to claim 2, wherein: the quadrangular tube further includes a fourth wall which is contiguous with the second wall and the third wall and which faces the first wall; and the elastic portion is elastically displaceable in directions in which the two open ends of the quadrangular tube are opposed to each other, in directions in which the first and the fourth wall face each other, and in directions in which the second and third walls face each other.

* * * * *